US010850919B2

(12) United States Patent
Brady

(10) Patent No.: US 10,850,919 B2
(45) Date of Patent: Dec. 1, 2020

(54) SYSTEM AND METHOD FOR PRODUCING A LINER IMPLEMENT

(71) Applicant: John R. Brady, Aliso Viejo, CA (US)

(72) Inventor: John R. Brady, Aliso Viejo, CA (US)

( * ) Notice: Subject to any disclaimer, the term of this patent is extended or adjusted under 35 U.S.C. 154(b) by 138 days.

(21) Appl. No.: 16/022,134

(22) Filed: Jun. 28, 2018

(65) Prior Publication Data

US 2020/0002086 A1 Jan. 2, 2020

Related U.S. Application Data

(63) Continuation-in-part of application No. 15/208,338, filed on Jul. 12, 2016, now abandoned.

(Continued)

(51) Int. Cl.

*B65F 1/00* (2006.01)
*B65F 1/06* (2006.01)

(Continued)

(52) U.S. Cl.

CPC ..... *B65F 1/002* (2013.01); *B65D 33/20* (2013.01); *B65D 75/5855* (2013.01); *B65F 1/06* (2013.01);

(Continued)

(58) Field of Classification Search

CPC ..... B65F 1/00; B65F 1/0006; B65F 1/002; B65F 1/06; B65D 33/20; B65D 33/165; B65D 75/5855; B65D 33/28; B31B 70/64

See application file for complete search history.

(56) References Cited

U.S. PATENT DOCUMENTS 4,008,851 A * 2/1977 Hirsch ..... B65D 33/165 383/62
4,906,108 A * 3/1990 Herrington ..... B65D 33/165 156/291

(Continued)

FOREIGN PATENT DOCUMENTS

FR 2848532 A1 6/2004

OTHER PUBLICATIONS

International Preliminary Report on Patentability on related PCT application (PCT/US2016/043400) from International Searching Authority (RU) dated Jan. 23, 2018.

(Continued)

*Primary Examiner* — Christopher R Harmon
(74) *Attorney, Agent, or Firm* — Klein, O'Neill & Singh, LLP

(57) ABSTRACT

A system including a liner implement that is configured to provide a lining for at least a receptacle, the liner implement includes an upper edge component having an outer surface portion and an inner surface portion. A retention strip implement engages the upper edge component, to tighten the upper edge component around an upper opening of the receptacle. A first end segment of the retention strip implement is configured to engage the outer surface portion of the liner implement. A second end segment is configured to engage the inner surface portion of the liner implement being operable for tightening the upper edge component around an upper element of said receptacle. An adhesive free area is configured to be operable for grasping during the engagement of the second end segment adhesive with the inner surface portion of the liner implement upper edge component.

5 Claims, 7 Drawing Sheets

Related U.S. Application Data

(60) Provisional application No. 62/195,253, filed on Jul. 21, 2015.

(51) Int. Cl.

| | |
|---|---|
| ***B65D 33/20*** | (2006.01) |
| ***B65D 33/28*** | (2006.01) |
| ***B65D 75/58*** | (2006.01) |
| *B31B 70/64* | (2017.01) |
| *B65B 5/02* | (2006.01) |

(52) U.S. Cl.

CPC ..... *B31B 70/64* (2017.08); *B65B 5/022* (2013.01); *B65D 33/28* (2013.01)

(56) References Cited

U.S. PATENT DOCUMENTS

| | | | | |
|---|---|---|---|---|
| 4,975,688 | A * | 12/1990 | Gonzales | G08B 17/10 150/165 |
| 5,045,042 | A * | 9/1991 | Rutledge | B65D 33/165 493/194 |
| 5,913,606 | A | 6/1999 | Nicholson | |
| 6,029,844 | A | 2/2000 | Brady | |
| 6,893,158 | B1 * | 5/2005 | Tipp | B65F 1/06 156/270 |
| 2003/0042260 | A1 * | 3/2003 | Rossiter | B65D 25/16 220/495.08 |
| 2011/0200779 | A1 | 8/2011 | Wolfe | |
| 2012/0195531 | A1 | 8/2012 | Moehlenbrock | |
| 2013/0034316 | A1 * | 2/2013 | Reihanifam | B65F 1/002 383/71 |
| 2013/0188889 | A1 | 7/2013 | Fraser | |
| 2016/0278591 | A1 * | 9/2016 | Hutchins | B65F 1/002 |

OTHER PUBLICATIONS

International Search Report and Written Opinion on related PCT application (PCT/US2016/043400) from International Searching Authority (RU) dated Dec. 1, 2016.

* cited by examiner

SYSTEM AND METHOD FOR PRODUCING A LINER IMPLEMENT

CROSS-REFERENCE TO RELATED APPLICATIONS

The present continuation-in-part patent application claims priority benefit under 35 U.S.C. 120 of the U.S. nonprovisional patent application Ser. No. 15/208,338 entitled "LINER CONTRIVANCE", filed on 12 Jul. 2016, which further claims priority benefit of the U.S. provisional application for patent Ser. No. 62/195,253 entitled "TRASH CAN LINER WITH SELF ADHESIVE RETENSION STRIP" filed on 21 Jul. 2015 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to waste collection. More particularly, certain embodiments of the invention relate to a waste receptacle liner with a retention strip.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that plastic bag liners are often inserted into the interior of a trashcan, wastebasket or other waste-receiving receptacle to contain waste that may be placed in the receptacle. Typically, a user may open the liner, insert the closed end of the liner into the receptacle, and then fold the open end of the liner over and around the outer upper perimeter of the receptacle, which frequently includes a lip. In many cases the circumference of the open end of the liner may be larger than the circumference of the outer upper perimeter of the receptacle, in which case the liner may tend to slide down into the interior of the receptacle when waste is initially thrown in. Even in cases where the circumference of the open end of the liner is slightly smaller than the circumference of the outer upper perimeter of the receptacle, it may be common for a user to compress the waste down into the receptacle when the receptacle starts to get full and this may also result in the liner slipping down into the receptacle. When the liner slips down into the receptacle, waste, which is often wet or may leave residue, may come into contact with the inside of the receptacle. This may result in the need to clean the receptacle thereby negating one of the purposes of using a liner. One existing solution to help hold the liner in place is to tie the excess portion of the open end of the liner into a knot thereby reducing the circumference of the open end of the liner so it may fit more tightly around the outer upper perimeter of the receptacle. When using such approaches, it may be difficult to tie the knot at an appropriate place so that the open end of the liner still fits over the top circumference of the receptacle yet is tight enough so that the liner does not slip down into the receptacle under normal usage.

By way of educational background, an aspect of the related technology generally useful to be aware of is that one approach for holding a liner in place in a trash receptacle may include an adhesive patch applied directly to the upper, outer surface of a trash liner. To tighten the top of the liner around the top of a trash receptacle using such an approach, a user may crimp the liner at the location of the adhesive patch and adhere the patch to itself or to a portion of the liner thus decreasing the circumference of the upper portion of the liner. In some instances, involving such approaches, the adhesive may come into contact with the side of the trash receptacle, which may result in the difficult removal of the liner or adhesive residue on the receptacle. By way of educational background, another aspect of the related technology generally useful to be aware of is that some approaches for holding a trash liner in place in a receptacle may include inserts for securing the liner to the upper perimeter of the receptacle. One such approach comprises an elastic band built-in to a hem formed in the top of the liner along its full circumference. Another such approach comprises a collapsible cardboard strip, which is located at the top of the open end of the liner and may be used to hold the liner in an open configuration. One may expect that due to the construction of such approaches, these liners may not be able to be manufactured at the high speed and in the continuous motion process needed to make such liners in the most efficient and cost effective manner. Another problem with the aforementioned approaches is that many limit the ability to package the liners in the form of a continuous roll with intermittent perforations or having been cut and interleaved, similar to the way many liners are efficiently manufactured and packaged today. Yet another approach for securing a liner in a receptacle comprises a strip that is attached in a side seam of a liner. One problem with this approach is that a large portions of liners are made from resin that is melted and blown into a tube and therefore do not even have side seams.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view of the liner, and FIG. 1B is a partial perspective view of the liner showing the retention strip attached to the liner;

FIG. 2A is a front perspective view of the liner being inserted into the receptacle. FIG. 2B is a front perspective view of an upper edge of the liner being rolled over the receptacle. FIG. 2C is a front perspective view of the retention strip before adhesion. FIG. 2D is a front perspective view of the retention strip being adhered into place, and FIG. 2E is a front perspective view of the liner secured onto the receptacle;

FIG. 4A is a front perspective view of the underside of the rim, and FIG. 4B is a front perspective view of the waste receptacle with the lid in an open position.

Figure 1A:
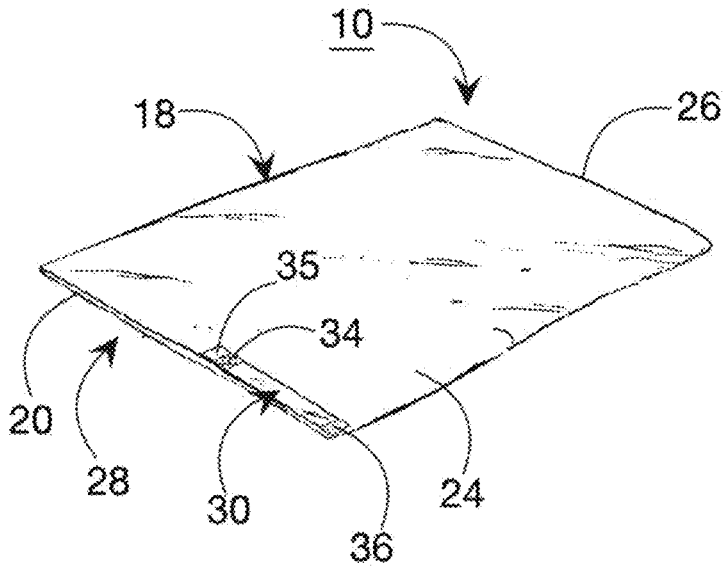
FIGS. 1A and 1B illustrates an exemplary flexible liner with a retention strip for insertion into a waste receptacle, in accordance with the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see *Ex parte Mallory,* 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See *Energy Absorption Sys., Inc.* v. *Roadway Safety Servs., Inc.*, Civ. App. 96-1264, slip op. at 10 (Fed. Cir. Jul. 3, 1997) (unpublished) *Hybridtech* v. *Monoclonal Antibodies, Inc.,* 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See *Seattle Box Co.* v. *Industrial Crating & Packing, Inc.,* 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. *Deering Precision Instruments, L.L.C.* v. *Vector Distribution Sys., Inc.,* 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See *Dana Corp*. v. *American Axle & Manufacturing, Inc*., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See *Cordis Corp*. v. *Medtronic AVE Inc.,* 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also *Deering Precision Instruments, LLC* v. *Vector Distribution Sys., Inc.,* 347 F.3d 1314, 1322 (Fed. Cir. 2003); *Epcon Gas Sys., Inc*. v. *Bauer Compressors, Inc.,* 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, *Liquid Dynamics Corp*. v. *Vaughan Co.,* 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In *Cordis Corp*. v. *Medtronic AVE, Inc.,* 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In *Anchor Wall Systems* v. *Rockwood Retaining Walls, Inc.,* 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see *Deering Precision Instruments, L.L.C.* v. *Vector Distrib. Sys., Inc.,* 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., *Epcon Gas Sys., Inc*. v. *Bauer Compressors, Inc.,* 279 F.3d 1022 (Fed. Cir. 2002) (construing the terms "substantially constant" and "substantially below"); *Zodiac Pool Care, Inc*. v. *Hoffinger Indus., Inc.,* 206 F.3d 1408 (Fed. Cir. 2000) (construing the term "substantially inward"); *York Prods., Inc*. v. *Cent. Tractor Farm & Family Ctr.,* 99 F.3d 1568 (Fed. Cir. 1996) (construing the term "substantially the entire height thereof"); *Tex. Instruments Inc*. v. *Cypress Semiconductor Corp.,* 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see *AK Steel Corp*. v. *Sollac,* 344 F.3d 1234, 68 USPQ2d 1280, 1285 (Fed. Cir. 2003) where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by *Pall Corp*. v. *Micron Separations, Inc.,* 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see *Verve LLC* v. *Crane Cams Inc.,* 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In *Andrew Corp.* v. *Gabriel Elecs. Inc.,* 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in *Ecolab Inc.* v. *Envirochem, Inc.,* 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see *Ecolab Inc.* v. *Envirochem Inc.,* 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see *Pall Corp.* v. *Micron Seps.,* 66 F.3d 1211, 1217, 36 USPQ2d 1225, 1229 (Fed. Cir. 1995); see, e.g., *Andrew Corp.* v. *Gabriel Elecs. Inc.,* 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see *Ex parte Mallory,* 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, are generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see *Norian Corp.* v *Stryker Corp.,* 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components is described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a receptacle, container, holder, repository, box, bin, canister, can or trashcan liner contrivance or mechanism that comprises a strip that can be used to tighten the upper edge of the liner around the outer upper perimeter of the trashcan thereby typically preventing the liner from sliding down into the trashcan when waste is placed inside or compressed into the trashcan. Some embodiments may be implemented to be used on receptacles, containers, holders, repositories, boxes, bins, canisters, cans or trashcans of various different shapes and sizes or other types of waste receptacles. Some embodiments may be configured so that their manufacture can easily be integrated into current manufacturing methods used to make liner implements.

Figure 1B:
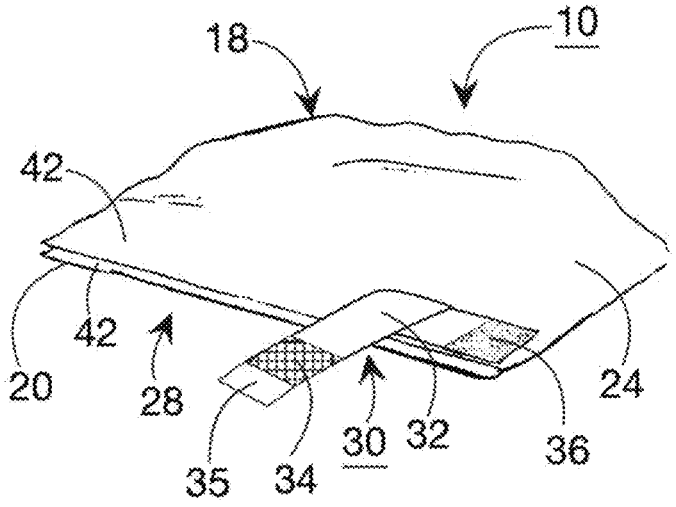

FIGS. 1A and 1B illustrate an exemplary flexible liner 10 with a retention strip 30 implement or tool for insertion into a waste receptacle, in accordance with the present invention. FIG. 1A is a front perspective view of liner 10, and FIG. 1B is a partial perspective view of liner 10 showing one end of retention strip 30 attached to liner 10. In the present embodiment, liner 10 comprises a continuous sidewall 18 which comprises an upper edge 20 and an outer surface 24. Liner 10 also comprises a closed bottom 26 and an open top 28, which is defined by upper edge 20 of sidewall 18. Retention strip 30 may be disposed on outer surface 24 of sidewall 18 adjacent to upper edge 20. Referring to FIG. 1B, an attached end 36 of retention strip 30 may be joined to liner 10 so that the other end may be folded back to expose an adhesive area that may be covered by a piece of release paper 34. In the present embodiment, sidewall 18 may be formed from thermoplastic resin that is melted and then blown into a tube thereby forming a continuous sidewall 18. The circumference of the tube may determine the width of the liner 10. Intermittent portions of the continuous sidewall 18 may then be joined across the width of the tube at desired intervals to form a closed bottom 26 of the liner 10. The distance between these joined portions will determine the depth of the liner 10. The continuous sidewall 18 can be cut or perforated just below where the tube is joined to form a closed bottom 26 so that the opposite end of the tube will form an open top 28. It is contemplated that a multiplicity of suitable methods may be used to join the intermittent sections of the continuous sidewall 18 to form the closed bottom 26 of the liner 10 including, without limitation, adhesive, sonic welding, heat welding, or other methods familiar to those skilled in the art. Alternatively sidewall 18 can be cut into desired lengths prior to forming the closed bottom 26 thereby forming a tube of a desired length with openings at each end. This allows for alternative methods of forming the closed bottom 26 such as, but not limited to, star seals or gusset seals that those skilled in the art will recognize can make the seal in the closed bottom 26 stronger and fit better into a receptacle. For other versions of liners, such as those that include draw strings, it can be advantageous to form the sidewall 18 of at least two identically configured side panels 42 which have inner and outer surfaces, upper and lower edges and opposed side edges. The lower and side edges of side panels 42 may be joined in a manner wherein the inner surfaces thereof face each other and, in combination, define an inner surface of liner 10. It is contemplated that a multiplicity of suitable methods may be used to join the edges of side panels 42 including, without limitation, adhesive, sonic welding, heat welding, or other methods familiar to those skilled in the art. The joined lower edges of side panels 42 may define closed bottom 26 of the liner 10, with the upper edges thereof, in combination, defining upper edge 20 and hence open top 28 of liner 10. In the present embodiment, side panels 42 have substantially rectangular configurations and may be fabricated from thermoplastic film, though other materials may be used as an alternative such as, but not limited to, other types of plastic, mesh, fabric, paper etc. Furthermore, in some alternate embodiments, the side panels may be configured in a various different shapes such as, but not limited to, shapes with rounded bottoms or tapered shapes. Those skilled in the art will readily recognize, in light of and in accordance with the teachings of the present invention, that the side wall of the liner in some embodiments may alternatively be formed from a single piece of material which may be folded in half and joined along its edges in a manner facilitating the formation of a continuous side wall, closed bottom and open top. Additionally, in other embodiments the liner may be formed from multiple sheets or panels, which are joined to each other in a manner facilitating the formation of a continuous side wall, closed bottom and open top.

In the present embodiment, retention strip 30 may have an overall length which is substantially less than the circumference of continuous sidewall 18 upon which retention strip 30 is positioned. Those skilled in the art will readily recognize, in light of and in accordance with the teachings of the present invention, that retention strips in some alternate embodiments may be shorter or longer. In the present embodiment, retention strip 30 may be oriented on a portion of the outer surface 24 of sidewall 18 such that the attached end 36 of retention strip 30 may be adjacent to one of upper edges 20 of sidewall 18. Attached end 36 of retention strip 30 may be joined to a portion of the outer surface 24 of the sidewall 18 by adhesive, sonic welding, heat welding, or other methods familiar to those skilled in the art. In the present embodiment, attached end 36 of retention strip 30 is shown as being located close to upper edge 20 of sidewall 18, yet it is contemplated that in some embodiments there may be some space between the attached end of the retention strip and the upper edge of the sidewall. Referring to FIG. 1B, retention strip 30 may comprise a middle section 32 with no adhesive between attached end 36 and the opposite end with adhesive covered by release paper 34. The length of middle section 32 may be of any length and in some embodiments may not be included at all so that the adhesive covered by release paper 34 portion of the retention strip is directly adjacent to the attached end of the retention strip. The retention strip 30 may also include an adhesive free portion 35 beyond the adhesive covered by release paper 34 portion of the retention strip. After a user removes the release paper 34 to expose the adhesive on that end of the retention strip 30, the adhesive free portion 35 provides a means to manipulate the retention strip and to avoid grasping the exposed adhesive during an attachment to an inside surface of the sidewall 18 near the upper edge 20. In the present embodiment, retention strip 30 may be rectangular in shape defined by two planer surfaces and two sets of opposed edges. Although it is contemplated that the retention strip in some embodiments may be implemented in various different shapes including, but not limited to, squares, round shapes, ovals, or other shapes. In the present embodiment, retention strip 30 may be made of the same material as liner 10, commonly a thin, flexible polyethylene, or retention strip 30 may be made of a multiplicity of suitable flexible materials such as, but not limited to, various different plastics, papers or fabrics. It is contemplated that the material making up retention strip 30 may be the same thickness as or thinner or thicker than the material making up liner 10. In some embodiments the retention strip may be made from a material with elastic properties, which may aid in cinching the liner tightly around the upper edge of the waste receptacle. In other embodiments the retention strip may be comprised of a material that does not stretch.

Figure 2A:
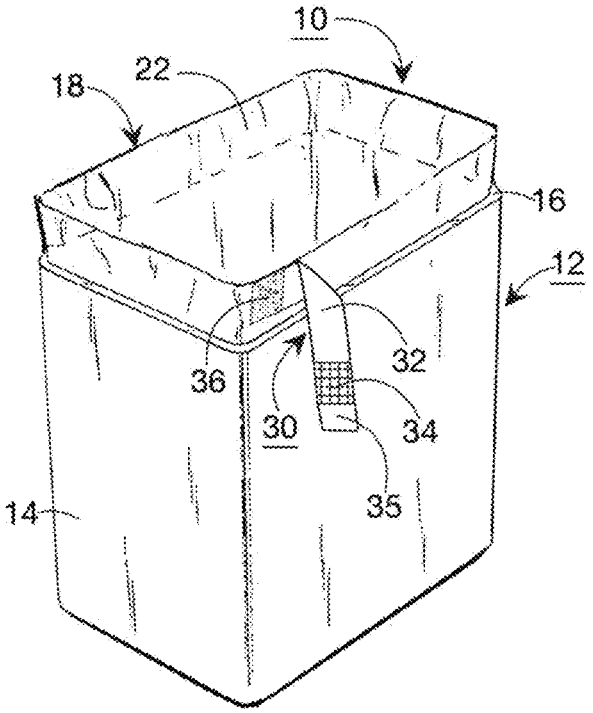
FIGS. 2A through 2E illustrate an exemplary process for securing a liner with a retention strip into a waste receptacle, in accordance with an embodiment of the present invention.
Figure 2B:
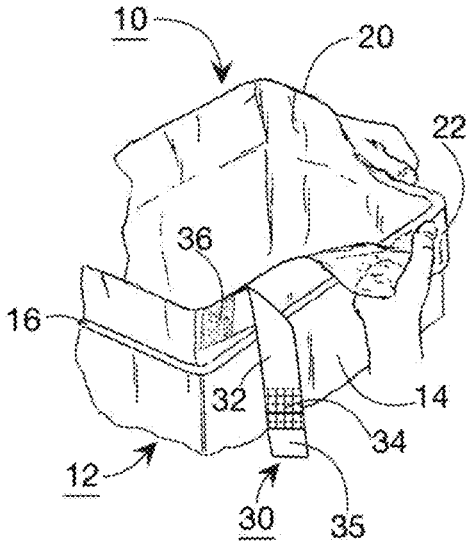
Figure 2C:
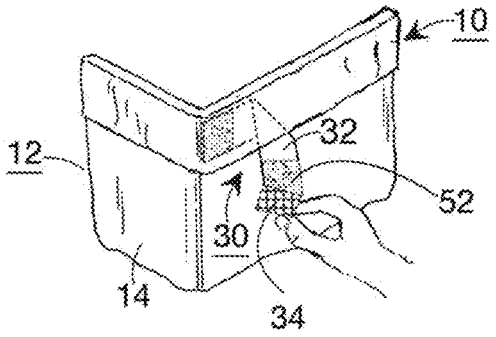
Figure 2D:
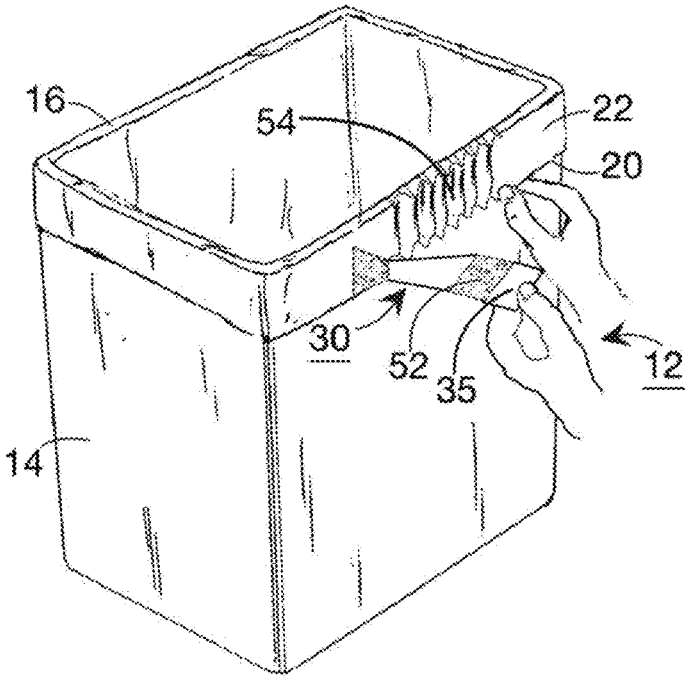
Figure 2E:
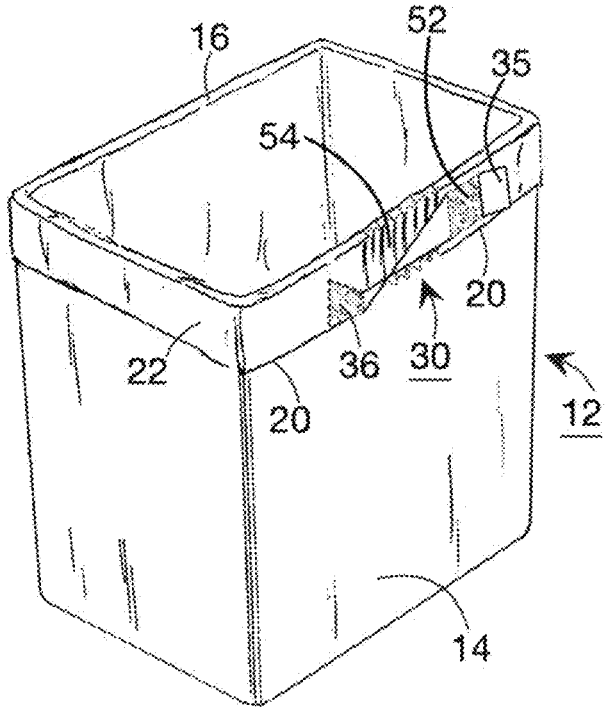

FIGS. 2A through 2E illustrate an exemplary process for securing a liner 10 with a retention strip 30 into a waste receptacle 12, in accordance with an embodiment of the present invention. FIG. 2A is a front perspective view of liner 10 being inserted into receptacle 12. FIG. 2B is a front perspective view of an upper edge 20 of liner 10 being rolled over receptacle 12. FIG. 2C is a front perspective view of the liner 10 with an upper edge 20 having been rolled over the opening of the receptacle 12. The end of retention strip 30 that is attached to an outer surface 24 of liner 10 is now between a sidewall of the receptacle 12 and a sidewall 18 of the liner 10. The retention strip 30 may be folded so that the opposite end of the retention strip 30 with the adhesive covered by release paper 34 may extend below the upper edge 20 of the liner 10. FIG. 2D is a front perspective view of the opening of liner 10 being tightened around the top of receptacle 12 and FIG. 2E is a front perspective view of liner 10 secured onto receptacle 12. In the present embodiment referring to FIG. 2A, liner 10 is typically inserted into waste receptacle 12, which may be a wastebasket, a trash/garbage can or the like. Waste receptacle 12 typically comprises a continuous vertical wall 14, which may define a top edge 16. Though waste receptacle 12 shown by way of example in FIGS. 2A through 2E has a substantially rectangular cross-sectional configuration and defines four distinct corner regions, it is contemplated that liner 10 may also be used in conjunction with waste receptacles having square, circular, oval or other cross sectional configurations.

In the present embodiment, once liner 10 is inserted into waste receptacle 12, the closed bottom of liner 10 is typically located near the bottom of waste receptacle 12 while the length of the sidewall 18 of liner 10 protrudes upwardly beyond top edge 16 of waste receptacle 12. Referring to FIGS. 2B and 2C, subsequent to the insertion of liner 10 into waste receptacle 12, upper edge 20 of side wall 18 of liner 10 may be folded or rolled over top edge 16 of waste receptacle 12 such that a portion of sidewall 18 comprising retention strip 30 may overlap vertical wall 14 of waste receptacle 12 and an inner surface 22 of liner may be revealed. Referring to FIG. 2C, an attached end 36 of retention strip 30 may be located between sidewall 18 of liner 10 and vertical wall 14 of waste receptacle 12 while the opposite, unattached, end of retention strip 30 with adhesive covered by release paper 34, may extend below upper edge 20 of side wall 18. This may enable the end of retention strip 30 with adhesive covered by release paper 34 to be easily accessible after liner 10 is inserted into waste receptacle 12. Thereafter, release paper 34 may be removed to expose the adhesive 52 under the release paper 34 on that end of retention strip 30. In the present embodiment, the adhesive 52 is on the same planer surface of retention strip 30 that is attached to liner 10. However, it is contemplated that the adhesive 52 can be on either planer surface of retention strip 30. After the release paper 34 is removed to expose the adhesive 52 on that end of the retention strip 30, the adhesive free portion 35 may provide a means for manipulating the retention strip 30, where the adhesive free portion 35 is configured to be grasped to avoid touching the adhesive itself. For example, the adhesive free portion 35 is configured to make it easier for to grasp the end of the retention strip 30 and pull it tight without the adhesive sticking to fingers. Those skilled in the art will readily recognize, in light of and in accordance with the teachings of the present invention, that a multiplicity of suitable attachment means other than adhesive may be used to attach the retention strip to the liner in some alternate embodiments such as, but no limited to, hook and loop material, small hooks or gripping teeth, clips, snaps, ties, buttons and loops, etc. The liner 10 could also include a second strip positioned similarly to the first strip in relation to the liner 10 but spaced apart so that the user could tie the ends of the strips together.

Now referring to FIG. 2D, in the present embodiment the adhesive free portion 35 on the unattached end of retention strip 30 may be grasped with one hand while at the same time a portion of upper edge 20 of side wall 18 can be grasped with the other hand wherein both hands are spaced apart and then pulled together creating a slack portion 54 of upper edge 20 of liner 10 thereby cinching the upper edge 20 tightly around waste receptacle 12 just below top edge 16. It is to be recognized that the difference between the circumference of upper edge 20 of liner 10 and the circumference of the open top of waste receptacles 12, can vary with different liners and waste receptacles. FIGS. 2D and 2E show a typical amount of slack 54, wherein the circumference of upper edge 20 of liner 10 is greater than the circumference of the open top of waste receptacle 12. The retention strip 30 comes attached to a portion of the outside surface of the upper edge 20 of liner 30. The free end of the strip with adhesive 52 covered by a release paper 34 may attach to the inside surface of the upper edge 20 of liner 22. The retention strip is configured to cross over and hold the slack portion 54 tight against the receptacle.

Now referring to FIG. 2E, subsequent to cinching upper edge 20 of liner 10 tightly around waste receptacle 12, the exposed adhesive 52 on retention strip 30 may be adhered to inner surface 22 of sidewall 18 of liner 10 near upper edge 20 such that slack 54 is typically between the adhesive 52 on retention strip 30 and attached end 36 of retention strip 30. It is to be understood that in some cases the exposed adhesive 52 on retention strip 30 may be adhered to the outer surface of liner 10 rather than inner surface 22, which typically can cinch slack 54 out of liner 10. However, by using the method shown by way of example in FIG. 2E in which the exposed adhesive 52 on retention strip 30 is attached to inner surface 22, the cinched portion of slack 54 may be held against the outer surface of waste receptacle 12 thereby typically preventing slack 54 to come up over top edge 16 of waste receptacle 12. In typical use of the present embodiment, cinching upper edge 20 of liner 10 around waste receptacle 12 just below top edge 16 can ordinarily be accomplished quickly and easily, thereby securing liner 10 to waste receptacle 12 with a minimum amount of difficulty. Furthermore, liner 10 with retention strip 30 may typically be used with varying differences between the size of the opening of liner 10 and the size of waste receptacle 12 as greater or lesser amounts of slack 54 can easily be taken out of liner 10. Once liner 10 is full of waste, liner 10 may be easily removed from waste receptacle 12, typically without leaving any adhesive residue on waste receptacle 12 as the exposed adhesive 52 on retention strip 30 usually remains on the surface of liner 10 not touching receptacle 12.

Figure 3:
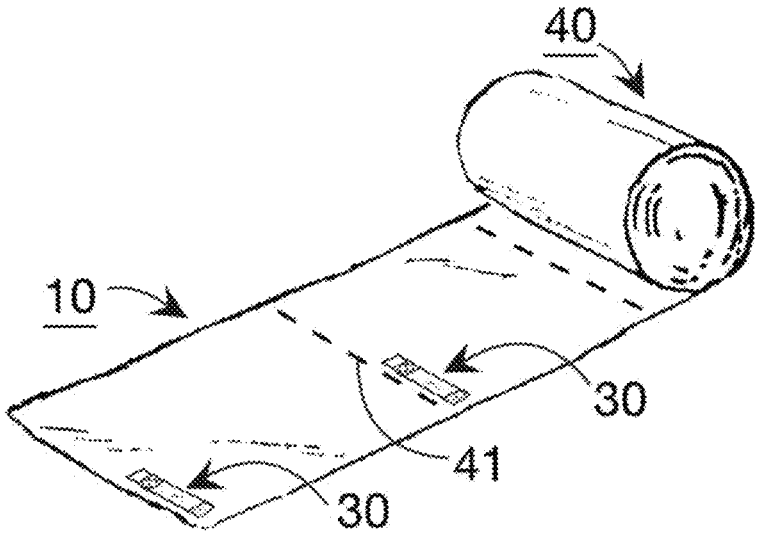
FIG. 3 is a side perspective view of an exemplary roll comprising liners with retention strips, in accordance with an embodiment of the present invention.

FIG. 3 is a side perspective view of exemplary roll 40 comprising liners 10 with retention strips 30, in accordance with an embodiment of the present invention. In the present embodiment, liners 10 may be manufactured and provided in the form of roll 40. In roll 40 liners 10 may be provided as a continuous sheet which includes laterally extending perforations 41 disposed at equidistantly spaced intervals along the entire length thereof. It is also to be understood that liners 10 can also be precut at equidistantly spaced intervals and interleaved as opposed to perforated when alternative bottom seal methods are used. It is contemplated that some methods for attaching self-adhesive retention strips 30 to liner 10 may easily be integrated into current manufacturing methods used to make conventional liners. For example, without limitation, because retention strips 30 may be added to the outside of liners 10, the manufacture of such embodiments may be automated by adding machinery that would apply retention strips 30 at the last stage before liners 10 are rolled up and packaged. Since retention strips 30 may be shorter than the width of the panel of liners 10 that would be exposed after the sheet of liners 10 is folded, which is common practice prior to rolling a continuous or precut and interleaved sheet of liners, retention strips 30 may be attached to liners 10 even if liners 10 are already folded.

Figure 4A:
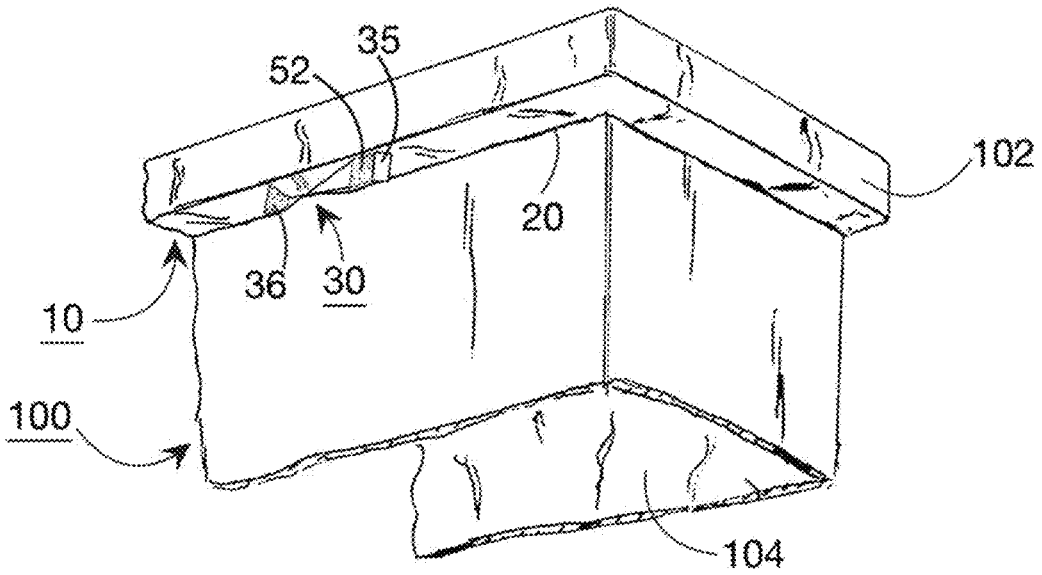
FIGS. 4A and 4B illustrate an exemplary liner with a retention strip in use in a waste receptacle having an outwardly extending rim and an integral lid.
Figure 4B:
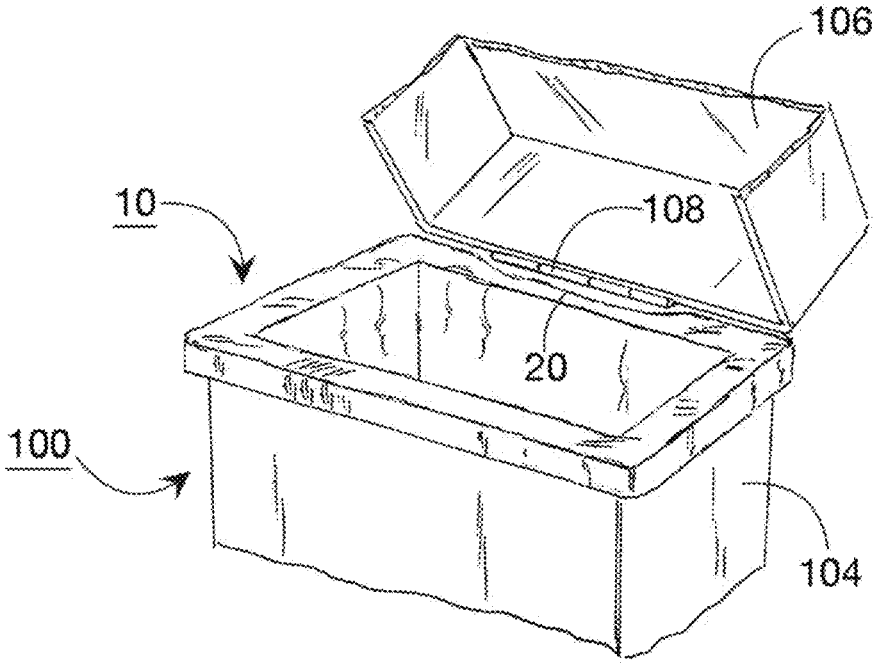

FIGS. 4A and 4B illustrate an exemplary liner 10 with a retention strip 30 in use in a waste receptacle 100 having an outwardly extending rim 102 and an integral lid 106. FIG. 4A is a front perspective view of the underside of rim 102, and FIG. 4B is a front perspective view of waste receptacle 100 with lid 106 in an open position. In the present embodiment, liner 10, constructed similarly to the liners described in the foregoing embodiments, may be utilized with waste receptacle 100 which is substantially similar to the previously described waste receptacle 12 but further comprises continuous rim 102 which extends outwardly from the top edge of a vertical wall 104 thereof and lid 106, which may be attached to wall 104 via a hinge 108 and is selectively openable and closable typically through the utilization of a foot pedal. Once liner 10 is inserted into waste receptacle 100, an adhesive end 52 of retention strip 30 may be adhered to a cinched portion of liner 10 underneath rim 102 of waste receptacle 100. Advantageously, the resultant constriction of an upper edge 20 of liner 10 about wall 104 of waste receptacle 100 underneath rim 102 thereof may enable rim 102 to aid in holding liner 10 in place without slippage thereof into waste receptacle 100. Referring to FIG. 4B, in the event waste receptacle 100 comprises lid 106 in addition to rim 102, a portion of upper edge 20 of liner 10 may be wrapped around the front of hinge 108, with the remainder of upper edge 20 being folded over rim 102 and tightly constricted about wall 104 of waste receptacle 100 underneath rim 102 thereof by retention strip 30 in the aforementioned manner.

Figure 5A:
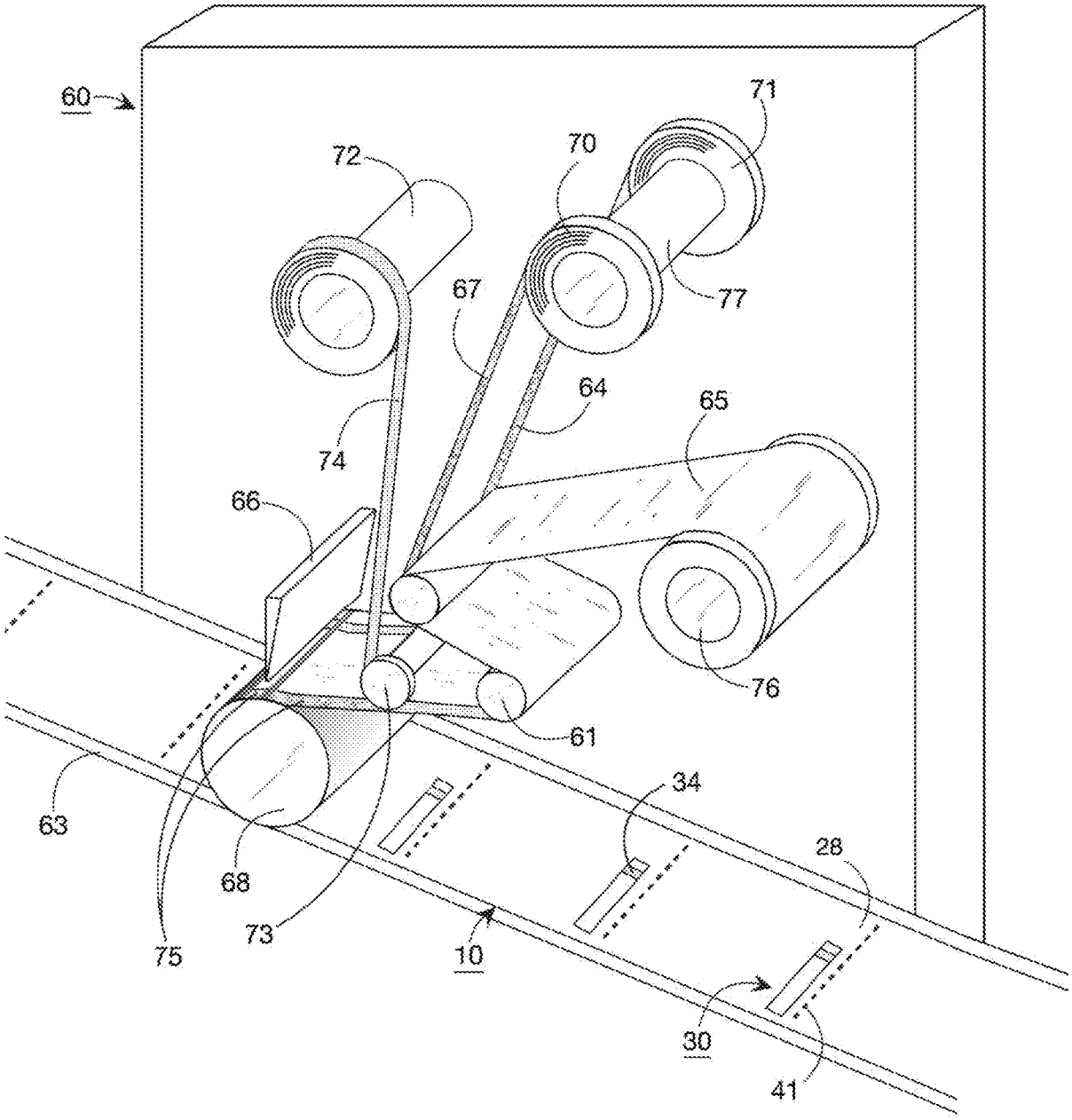
FIGS. 5A and 5B shows an exemplary machinery that may be used to attach the retention strip to the liner.
Figure 5B:
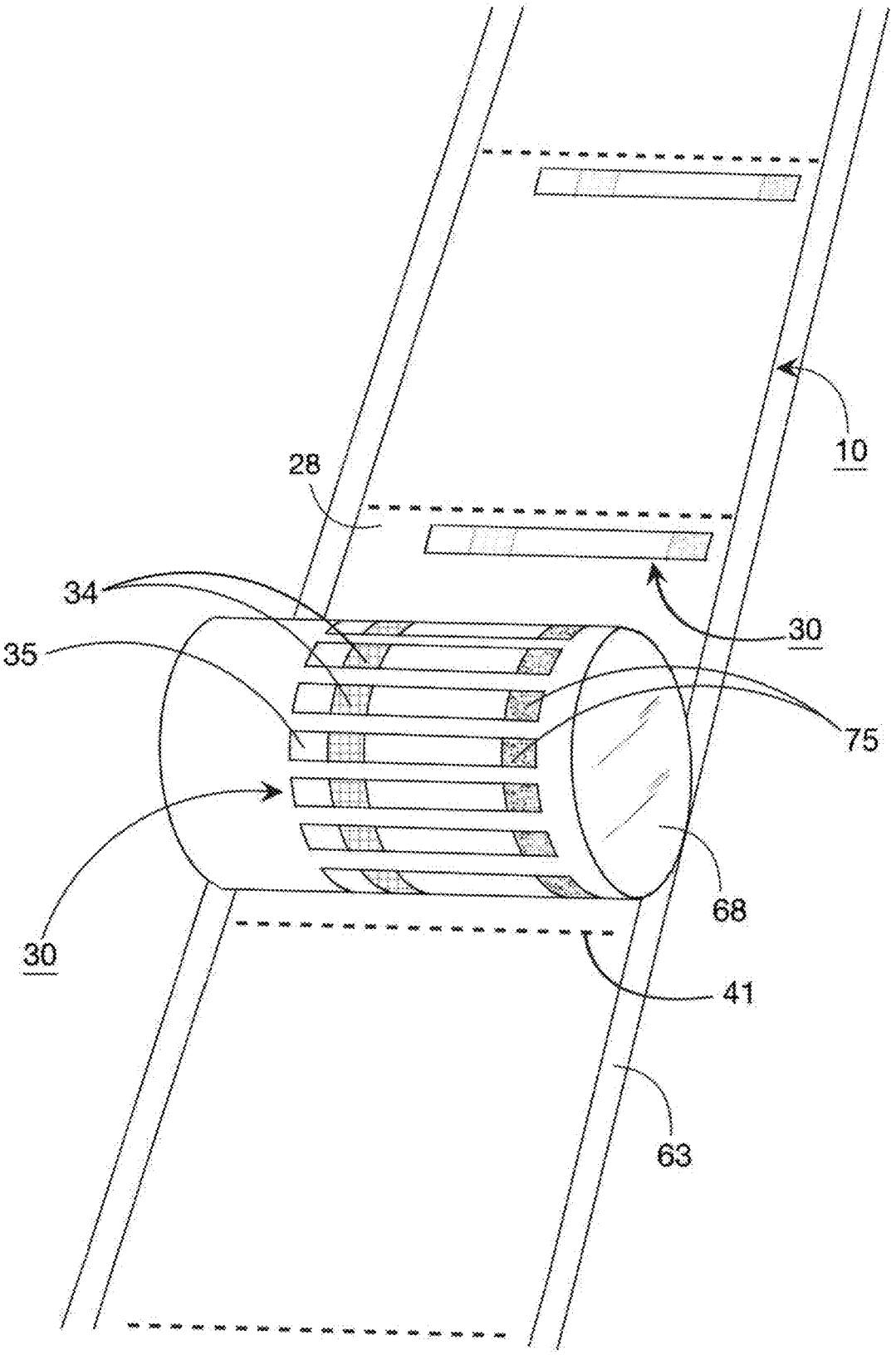

FIGS. 5A and 5B shows an exemplary machinery that may be used to attach the retention strip to the liner. FIG. 5A shows an example of machinery 60 that could be used to attach the retention strip 30 to a liner 10. It will be recognized by those skilled in the art that for a manufacturer to be competitive, the process of converting the raw material into a finished liner, must take as little time as possible. Therefore manufacturers rely on machinery that can convert the plastic film into finished liners in a high speed, continuous motion process. Many prior art solutions could not be integrated into the current high speed, continuous motion converting machinery required by competitive manufacturers of liners. Having a strip attached on the inside surface of a liner may require a major change to the process. Other methods such as having a strip attached in the side seams of a liner may not work for liners that are formed from a tube and may not include side seams. FIG. 5A shows liners 10 after having been converted from plastic resin that has been blown into a tube and then folded to a desired width and perforated 41 at equidistant intervals in a prior stage. In one embodiment, the liners 10 may include a thermoplastic film that has been formed into a tube with a closed bottom and open top. The liners, thus formed, are shown coming in on a continuous motion conveyer belt 63 ready to be rolled up and packaged at the next stage. It is to be recognized that liners 10 that may have been formed using alternative bottom seal methods such as star, gusset, or other commonly used methods, which require the liners to be precut and interleaved at this stage as opposed to being perforated. The method shown in FIG. 5A may work with liners that have been precut and interleaved in that the interleaving process only overlaps a portion of the end of one liner with the opposite end of the next liner on the conveyor belt 63. The outer surface of the liners 10 where the retention strip 30 is shown being attached in FIG. 5A, may still be exposed so that retention strips 30 may be attached at or near the open end 28 of the liners 10. The machinery 60 that may attach the retention strips 30 to the liners 10 may be integrated into the current process of converting plastic film into liners 10 at the stage shown which would be just prior to the liners 10 being rolled up and packaged. It is anticipated that the machinery 60 would use rotary rollers 61 similar to those commonly used to convert plastic film into liners 10. These rollers 61 may guide and feed a desired/predetermined width of plastic film 65 so that it may be converted into retention strips 30. Rolls of adhesive and release paper 70, 71 may be positioned on a roller 77 so that as the plastic film 65 is pulled through the rollers 61, strips of the adhesive and release paper 64, 67 may be pulled off the rolls 70, 71 so that the adhesive under the release paper may be exposed and come into contact with the surface of the film 65 thereby adhering the strips of release paper and adhesive 64, 67 to the plastic film 65 at or near its edges. The release paper by itself 74 from one of the strips of release paper and adhesive 67 may be peeled off so that the, now, exposed adhesive 75 under the release paper 74 may remain on that end of the plastic film 65. FIG. 5A shows the release paper without adhesive 74, being rolled onto a cylinder 72. Cylinder 72 may rotate to pull the release paper without adhesive 74 off of the film 65 at a desired speed that may match with the speed at which the film 65 is being pulled through the rollers 61. A guiding mechanism 73 may be located so that the release paper without adhesive 74 may be peeled off at a desired/predetermined stage in the process. FIG. 5A shows it being peeled off just before the film 65 is to be cut to form a retention strip 30. Those skilled in the art will recognize that one form of adhesive and release paper, commonly known as transfer tape, is comprised of only the release paper and adhesive while another form of release paper and adhesive known as double sided tape, also includes a carrier that is coated on both sides with adhesive. An advantage to using the double sided tape form of release paper and adhesive with a carrier is that the carrier may be stiffer than the film thereby making it less likely for the adhesive patch to fold in on itself. However, either form of release paper and adhesive may be used for the current invention. It is also to be recognized that, alternatively, the adhesive and release paper 64, 67 may be attached to the film 65 in a separate, earlier process so that the film 65 would already have the adhesive and release paper 64, 67 attached before being fed into the machinery 60 without affecting the rest of the process shown in FIG. 5A. In the example shown in FIG. 5A the strips of adhesive and release paper 64, 67 on rolls 70, 71 may be positioned so that the strips 64, 67 may come off the rolls and be attached to the film 65 just before the film is cut into the retention strips 30 and attached to the outer surface of the liners 10. The machinery 60 would include a cylinder 68 that would grip the film 65 after the adhesive and release paper 64, 67 had been attached. The cylinder 68 could grip the film 65 using vacuum pressure or mechanical grippers. The machinery 60 may also include a cutter 66 that may cut the film 65 into the desired/predetermined width for each retention strip 30. The cylinder 68 may rotate and may be programmed so that it would stop as the film 65 was cut and may rotate at a desired speed so that the retention strip 30 may be held by the cylinder 68 as it is rotated to substantially attach the retention strip 30 near the opening 28 of each liner 10. This rotary process may allow the retention strips 30 to be attached to the liners 10 without slowing down the manufacturing process. Attaching retention strips 30 to liners 10 using this process may not require slowing down the process at which liners are currently manufactured. Therefore, after the initial cost of the machinery 60 and its instillation, the only additional cost to add the retention strips 30 may be for the film 65 and the adhesive and release paper 64, 67. It is anticipated that liners 10 with retention strips 30 may give the manufacturers and resellers of such liners a competitive advantage without significant additional cost compared to liners without retention strips 30. It is to be understood that the exact arrangements and numbers of the rollers 61 the cylinder 68 the cutter 66 and other elements of the machinery 60 may vary without affecting the end result of attaching retention strips 30 to liners 10 at the high, continuous motion speeds currently used to efficiently manufacture liners 10. It is also to be recognized that the machinery 60 may also attach retention strips 30 to liners that are formed with separate side panels 42 and include such additional features as draw tapes or extended flaps used to tie the liner closed after being filled. It is also to be understood that the adhesive and release paper 64 may be adhered to the opposite planer surface of the film 65 as the side it is shown being adhered to in FIG. 5A. This may result in the release paper 34 being on the opposite planer surface of retention strip 30 that is attached to liner 10. This may not affect the function of the retention strip 30 as a user could still access that end of the retention strip 30 after inserting the liner 10 with the retention strip 10 into a waste receptacle. One may still remove the release paper 34 to expose the adhesive 52 and adhere it to the inner surface of the liner 22 after cinching the upper edge 20 of liner 10 tightly around waste receptacle 12.

In some embodiments retention strips 30 may be attached to liners 10 that have drawstrings located in a hem at the open tops of the liners 10. These types of liners 10 may be provided as individual units that may be rolled up and packaged together. Even with a drawstring at the open top, such a liner 10 may easily be cinched around the top of a waste receptacle with a retention strip 30, and subsequent to being filled with waste, the liner could be easily removed and closed by using the drawstring to close the liner 10 without any hindrance caused by the retention strip 30 having been used. In other embodiments, liner 10 may include, but not limited to, bands, handle ties or drawstrings that are built-in to hems created around/surrounding the upper edges of liner 10 to make it easier to remove and seal the liner 10 when it is full.

FIG. 5B shows a view of the cylinder 68 from the side opposite that shown in FIG. 5A. FIG. 5B shows how multiple retention strips 30 may be cut and held by vacuum pressure to the cylinder 68. Using vacuum pressure to hold the retention strips 30 has the advantage of there being no need for anything to come into contact with the exposed adhesive 75. It is to be understood that alternative methods such as additional rollers made out of non-stick silicone or coated with polytetrafluoro ethylene or similar non-stick materials may be used to hold the retention strips with the exposed adhesive. It is also to be understood that more or less retention strips 30 may be cut and held on the cylinder 68 ready to be adhered to the liners 10. It may be just one retention strip 30 cut and adhered to the liner 10 before the next one is cut and attached. In the preferred method shown in FIG. 5B, there may be several retention strips 30 that have been cut and may be held by vacuum pressure so that the cylinder 68 only has to rotate a small amount as the liners 10 come by on the conveyor belt 63. The cylinder 68 may be programmed to rotate so that the retention strips 30 may be adhered at or near the opening 28 of each liner 10 without having to change the speed of the conveyor belt 63. Those skilled in the art will recognize that there are various commonly used optical and other physical sensors that can be used to ensure accurate, repeatable placement of the retention strips 30 on the liners 10. In some embodiments, the adhesive 52 on the adhesive end of the retention strips 30 may not be disposed all the way to the edges of the strip thereby creating some space around the adhesive 52 on the adhesive end where there is no adhesive. The portion without adhesive could be easier to grip by the machinery used to automate the process of attaching the retention strips to the liners. The adhesive free area created around the adhesive 52 on the adhesive end, may also include holes to make it easier to grip and consistently align by machine. Moreover, since the present embodiment may not require anything that must be packaged separately from the liners and the retention strips and release paper may be made of a thin material, liners 10 may be packaged in packaging substantially similar to or the same as packaging used for conventional liners. In some alternate embodiments, the manufacturing process may alternate which side of the liner, right or left, to which the retention strip is attached to help prevent one side of the roll of liners from being thicker than the other.

Those skilled in the art will readily recognize, in light of and in accordance with the teachings of the present invention, that embodiments of the present invention may be implemented as liners that are not available in a continuous, perforated roll. For example, without limitation, in some embodiments retention strips may be attached to liners that have drawstrings located in a hem at the open tops of the liners. These types of liners are typically provided as individual units that may be rolled up and packaged together. Even with a drawstring at the open top, such a liner may easily be cinched around the top of a waste receptacle with a retention strip, and subsequent to being filled with waste, the liner could be easily removed and closed by using the drawstring to close the liner without any hindrance caused by the retention strip having been used. Other embodiments may also be configured as various different trashcan liner designs such as, but not limited to, those that include bands, handles or drawstrings that are built-in to hems created around the upper edges of some liners to make it easier to remove and seal the liner when it is full.

It is further contemplated that some embodiments of the present invention may be used with virtually any type of waste receptacle, for example, without limitation, trash cans with or without lips and those with built-in lids.

In some embodiments of the present invention the retention strips may be provided separately from the liners. In these embodiments both ends of the retention strips may comprise some type of attachment means such as, but not limited to, adhesive. In typical use of these retention strips, once a liner is inserted into a receptacle and the upper edge is rolled over the top of the receptacle, one end of the retention strip may be attached to the liner. Then, the slack portion of the liner may be cinched toward the attached end of the retention strip and the other end of the retention strip may be attached to the liner to secure the slack in place.

It is contemplated that in some alternate embodiments the retention strip may be attached to the inner surface of the liner rather than the outer surface so that the retention strip is completely accessible once the top edge of the liner is folded over a receptacle. Other alternate embodiments may comprise a slit or hole through which retention strip may be inserted so that when the retention strip is attached to the outer surface of the liner the retention strip can be inserted through the slit or hole to be accessed from the inner surface once the liner is folded over the top edge of a waste receptacle. Yet other alternate embodiments may comprise retention strips that are long enough to wrap completely around a waste receptacle. Such embodiments may be particularly useful for use with receptacles comprising a rim as the retention strip may aid in holding the retention strip in place. Yet other alternate embodiments may comprise multiple retention strips.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a waste receptacle liner with a retention strip according to the present invention will be apparent to those skilled in the art. Various aspects of the invention have been described above by way of illustration, and the specific embodiments disclosed are not intended to limit the invention to the particular forms disclosed. The particular implementation of the liner with retention strip may vary depending upon the particular context or application. By way of example, and not limitation, the liners described in the foregoing were principally directed to implementations configured for trashcans; however, similar techniques may instead be applied to liners for other types of receptacle such as, but not limited to, recycling bins, compost bins, laundry hampers, litter boxes, etc., which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system comprising:

a liner implement that is configured to provide a continuous tubular lining for at least a receptacle, in which said liner implement comprises an open top section, and in which said open top section comprises an upper portion, wherein said upper portion comprises an outer surface portion and an inner surface portion;

a retention strip implement, wherein said retention strip implement engages solely the outer surface portion of said upper portion, and wherein said retention strip implement is further configured to tighten said upper portion around an upper opening of said receptacle;

a first end segment of said retention strip implement, in which said first end segment engages solely said outer surface portion of said liner implement;

a second end segment of said retention strip implement, in which said second end segment comprises an adhesive area disposed on said second end segment, wherein said second end segment adhesive area engages said inner surface portion of said liner implement when the liner implement is disposed within the receptacle to tighten said upper portion around said upper opening of said receptacle; and in which said second end segment further comprises an adhesive free area that is configured to be operable for grasping during said engagement of said second end segment adhesive with said inner surface portion of said liner implement upper portion;

wherein a length between said first and second end segments is greater than a distance from said attachment of said first end segment on said outer surface portion of the liner implement and an upper edge of the upper portion of the liner implement.

2. The system of claim 1, further comprising a release paper implement, wherein said release paper implement is configured to cover said second end segment adhesive area when not in use.

3. The system of claim 2, further comprising a retention strip middle section disposed between said retention strip implement's first and second end segment, wherein said retention strip middle section is configured to fold or twist when said retention strip second end segment adhesive engages said inner surface portion to tighten said upper portion around said upper opening of said receptacle.

4. The system of claim 2, in which said adhesive area and release paper comprises at least one of, a transfer tape and a double sided tape with a carrier.

5. A method of tightening an upper portion of a liner around an upper opening of a receptacle, the method comprising the steps of:

providing the receptacle;

providing the liner having:

a continuous tube with a closed bottom for lining the receptacle, the continuous tube comprises an open top section, and the open top section comprises the upper portion, wherein the upper portion comprises an outer surface portion and an inner surface portion;

a retention strip, wherein the retention strip engages solely the outer surface portion of said upper portion, and wherein said retention strip implement is further configured to tighten said upper portion around the upper opening of said receptacle;

a first end segment of said retention strip implement, in which said first end segment engages solely said outer surface portion of said liner implement before the retention strip element tightens said upper portion around said upper opening of said receptacle;

a second end segment of said retention strip implement, in which said second end segment comprises an adhesive area disposed on said second end segment, wherein said second end segment adhesive area engages said inner surface portion of said liner implement to tighten said upper portion around said upper opening of said receptacle; and in which said second end segment further comprises an adhesive free area that is configured to be operable for grasping during said engagement of said second end segment adhesive with said inner surface portion of said liner implement upper portion;

wherein a length between said first and second end segments is greater than a distance from said attachment of said first end segment on said outer surface portion of the liner implement and an upper edge of the upper portion of the liner implement;

inserting the liner into the receptacle;

folding the upper portion of the liner over the upper opening of the receptacle so that the closed bottom is disposed within the receptacle, the upper portion of the liner is disposed outside of the receptacle adjacent to the upper opening of the receptacle and the first end segment of the retention strip is disposed between outer surfaces of the liner;

gripping the second end segment of the retention strip;

routing the retention strip over the upper edge of the upper portion of the liner;

securing the second end segment of the retention strip to the inner surface of the liner.

* * * * *